US010696539B2

(12) United States Patent
Goldner et al.

(10) Patent No.: US 10,696,539 B2
(45) Date of Patent: Jun. 30, 2020

(54) ADJUSTABLE SADDLE CARRIER AND STORAGE BIN

(71) Applicants: Carissa S. Goldner, Moraga, CA (US); Jack Goldner, Moraga, CA (US); Nancy V. Goldner, Moraga, CA (US)

(72) Inventors: Carissa S. Goldner, Moraga, CA (US); Jack Goldner, Moraga, CA (US); Nancy V. Goldner, Moraga, CA (US)

(73) Assignee: Carissa Goldner, Walnut Creek, CA (US)

( * ) Notice: Subject to any disclaimer, the term of this patent is extended or adjusted under 35 U.S.C. 154(b) by 491 days.

(21) Appl. No.: 15/716,394

(22) Filed: Sep. 26, 2017

(65) Prior Publication Data

US 2018/0093879 A1 Apr. 5, 2018

Related U.S. Application Data

(60) Provisional application No. 62/404,079, filed on Oct. 4, 2016.

(51) Int. Cl.

| | |
|---|---|
| ***B68B 9/00*** | (2006.01) |
| ***A45F 3/02*** | (2006.01) |
| ***A45F 3/10*** | (2006.01) |
| ***B68C 1/00*** | (2006.01) |
| *A45C 5/14* | (2006.01) |

(52) U.S. Cl.

CPC ..... *B68B 9/00* (2013.01); *A45F 3/02* (2013.01); *A45F 3/10* (2013.01); *B68C 1/002* (2013.01); *A45C 5/14* (2013.01); *A45F 2200/05* (2013.01)

(58) Field of Classification Search

CPC .. B68C 1/002; B68C 1/20; B25H 3/02; B68B 9/00

USPC ..... 211/85.11; D30/143

See application file for complete search history.

(56) References Cited

U.S. PATENT DOCUMENTS 1,761,453 A * 6/1930 Rankin ..... B25H 3/02 312/244
2,403,324 A * 7/1946 Anderson ..... B68C 1/002 69/19
2,777,597 A * 1/1957 Ruff ..... B65D 21/0212 206/509
3,476,255 A * 11/1969 Ciancio ..... B68C 1/002 211/85.11

(Continued)

FOREIGN PATENT DOCUMENTS

DE 7900340 * 4/1979 ..... B68C 1/002

*Primary Examiner* — Christopher D Hutchens

(74) *Attorney, Agent, or Firm* — Foundation Patents LLC; Richard Bennett Salles

(57) ABSTRACT

A combination saddle carrier and storage bin comprising a substantially rectangular box including a lower base portion, and a proximal arched front panel and a symmetrical distal arched back panel, and having symmetrical rectangular side panels which fan upward and away from said lower base portion at about 95 degrees to about 115 degrees with respect to the base portion; and an uppermost saddle-support rail connecting the uppermost regions of said front and back panels, wherein said rail comprises a central groove along which slide adjustable generally triangular-shaped cantle and pommel support pieces, said pieces being temporarily fixable via sex bolts removably inserted into holes equally spaced horizontally along said rail.

20 Claims, 3 Drawing Sheets

(56) References Cited

U.S. PATENT DOCUMENTS

| | | | | | |
|---|---|---|---|---|---|
| 4,058,210 | A | * | 11/1977 | Mitchell | B25H 3/02 206/372 |
| D277,515 | S | * | 2/1985 | Secor | D30/143 |
| 4,768,656 | A | * | 9/1988 | Hartley | A47B 81/00 211/184 |
| 5,165,553 | A | * | 11/1992 | Benson | B25H 1/06 211/175 |
| D377,548 | S | * | 1/1997 | O'Shea | D30/143 |
| D509,631 | S | * | 9/2005 | Glassey | D30/143 |
| 2006/0037881 | A1 | * | 2/2006 | Redzisz | A45C 7/0036 206/373 |
| 2007/0056868 | A1 | * | 3/2007 | Godshaw | A45C 5/14 206/373 |

* cited by examiner

ADJUSTABLE SADDLE CARRIER AND STORAGE BIN

CSS-REFERENCE TO RELATED APPLICATIONS

This application claims priority to U.S. Provisional Application No. 62/404,079 filed Oct. 4, 2016. The content of the above application is incorporated by reference in its entirety.

FIELD OF THE DISCLOSURE

The present invention relates to the field of saddle carriers, saddle stands, saddle racks, saddle storage systems, tack & grooming-equipment containers and organizing storage units.

BACKGROUND

Many saddle racks, or saddle carriers, are purely box-shaped, preventing a mounted saddle from lying naturally on the carrier as it does on a horse's back. These carriers therefore place stress on the saddle's inner tree (spine—customarily laminated-wood-&-rawhide or fiberglass), eventually breaking down the saddle's integrity so it can no longer support a rider with its intended lift.

Other saddle carriers are wall racks, outshooting wall rods or rudimentary wall beams used as temporary saddle mounts. Still other carriers function only as railed spines to hold a saddle without tack or grooming equipment, and they are not portable. These racks are essentially a makeshift rail between two posts. Still other combination rack-carriers have flat vertical-perpendicular side rails which cut inner sheepskin/wool or leather, have no rounded edges (so likewise cut the saddle), and they have no adjustable cantle and pommel regions, therefore limiting themselves to a single, one-sized saddle.

The instant invention addresses the above issues by providing a custom fit support for various saddles while being carried by hand, transported in a vehicle and/or stored. The instant invention also functions as a stable "spill free" storage container for tack, grooming supplies and other accessories. The unit's bell-shaped end pieces provide additional stability for a mounted saddle. The unit's sloped side panels give the saddle skirts the proper space and angle they require to maintain their fastenings, their shape-integrity, and the fine contours of their decorative designs without being squashed or cut by adjacent items. The rounded crossbar rail and rounded wood [adjustable] pommel and cantle pieces keep the saddle's leather and the under-sheepskin from catching or tearing.

Definitions

"oeo": acronym for "one embodiment of" (or "o.e.o").

SUMMARY

The disclosed invention is a saddle rack carrier with enclosed tack box/bin. The rack carrier features adjustable cantle and pommel support pieces which, by sliding along a central top grooved rail and removably fixing themselves via sexbolts, allow a rider to stow and carry their saddle and tack without compromising the saddle spine's integrity over time. In addition, the carrier bin features angled side walls which fan out from the bin base at an angle of between approximately 110 degrees to approximately 125 degrees. These angled side walls are unique in the industry, and allow saddle skirt, stirrups and flaps to rest on the unit without unduly stressing the unit's spine.

BRIEF DESCRIPTION OF THE DRAWINGS

The drawings described herein are for illustrative purposes only of selected embodiments and not all possible implementations and are not intended to limit the scope of the present disclosure.

DETAILED DESCRIPTION OF THE DRAWINGS AND SAMPLE EMBODIMENTS

Figure 1:
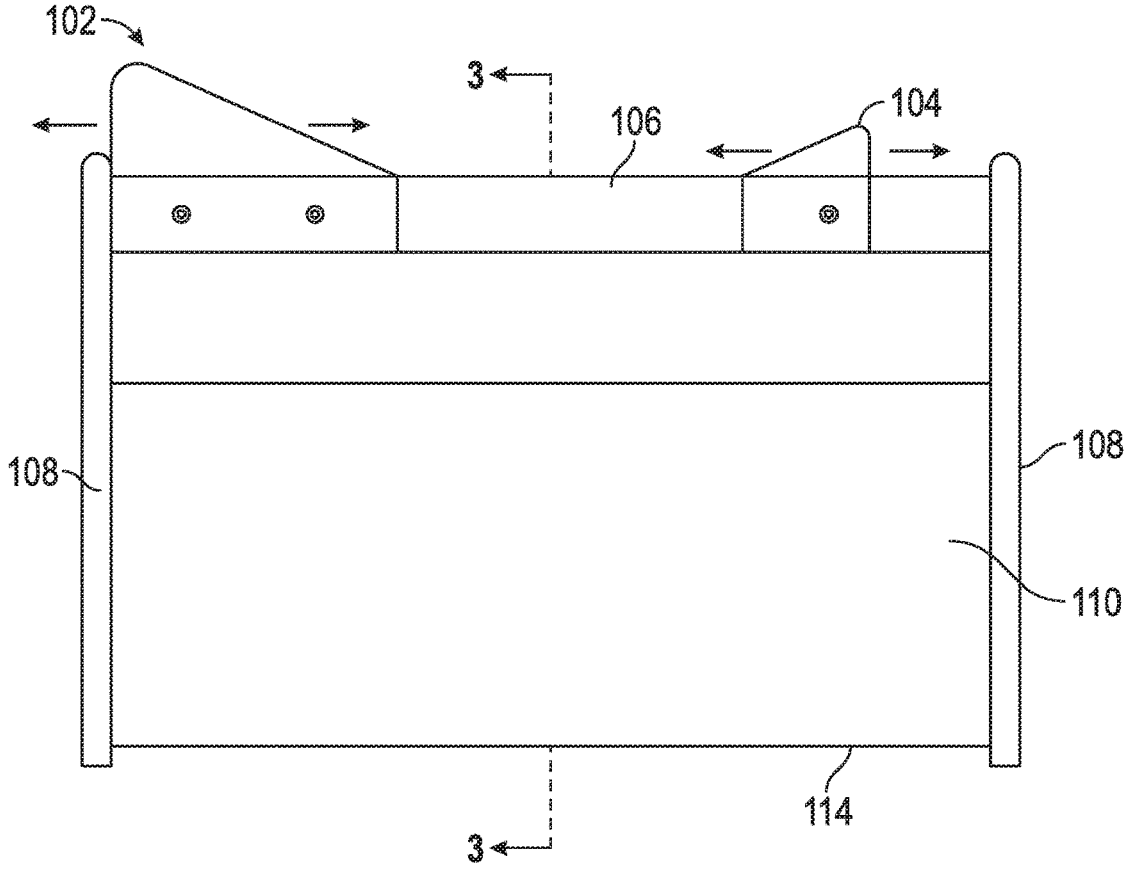
FIG. 1: Side view of one embodiment of the invention.

In the Summary above, this Detailed Description, the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

The term "comprises" and grammatical equivalents thereof are used herein to mean that other components, ingredients, steps, among others, are optionally present. For example, an article "comprising" (or "which comprises") components A, B and C can consist of (i.e., contain only) components A, B and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)—(a second number)," this means a range whose limit is the second number. For example, 25 to 100 mm means a range whose lower limit is 25 mm and upper limit is 100 mm.

Aspects of the disclosed invention may be embodied as a system, method or process, or computer program product. Accordingly, aspects of the disclosed invention may take the form of an entirely hardware embodiment, an entirely software embodiment (including firmware, resident software, micro-code, etc.) or an embodiment combining software and hardware aspects that may all generally be referred to herein as a "circuit," "module," "program," "device," or "system." Furthermore, aspects of the disclosed invention may take the form of a computer program product embodied in one or more computer readable media having computer readable program code embodied thereon.

Any element in a claim that does not explicitly state "means for" performing a specified function, or "step for" performing a specific function is not to be interpreted as a "means" or "step" clause as specified in 35. U.S.C. § 112 1¶6. Specifically, the use of "step of" in the claims herein is not intended to invoke the provisions of U.S.C. § 112 1¶6.

FIG. 1 depicts a side view of oeo the invention. The front and back panels 108 support the top rail/crossbar 106. These front and back panels 108 are substantially arched, having a wide base region and a relatively narrow rounded upper region. The crossbar comprises an inner central groove (shown infra), wherein the adjustable pommel piece 102 and adjustable cantle piece 104 are positioned and move to slide laterally along said groove until secured by bolt (shown infra) or peg or pin. The top crossbar rail may alternatively comprise a shelf so as to accommodate additional carriers stacked atop the instant invention. The pommel and cantle pieces are substantially triangular shaped, but may be any shape to accommodate a saddle without injury. The angled side panels 110, which are each substantially rectangular in shape, allow for the saddle, when mounted atop the invention's top crossbar 106, to keep its saddle flaps (a.k.a./comprising inter alia fenders, plates, skirt) fanned out to the side, allowing the saddle's spine to remain free of lateral stresses. The angled side panels 110 also make for easier access to the central cavity's storage bin (for saddle pads, tack, grooming materials and accessories) formed by side panels 110 end panels 108 and base 114)], as many items are visible (unlike with a perpendicular/thin/shielded perpendicular box) and yet remain stable as in a covered-toolbox. Tack blankets may be stored in the bin as well as rest on the top rail 106 above or below the saddle (not shown). Said angle for said side panels 110 should therefore ideally be slightly obtuse [in relation to unit spine's level base 314], ranging from about 91° to about 139°. However, any angle that keeps saddle flaps (fenders, plates, skirt) sufficiently fanned away from the spine, while allowing user access to the storage bin, is acceptable.

In the preferred embodiment, the angle from base to each side panel is an obtuse 112°. Any appropriate range substantially about this angle supports the skirt, stirrup leathers and stirrups, as well as the flaps from knee roll to thigh roll. This unique support reduces stress on the spine of the saddle by adding additional support to hold the weight of the leather and stirrups, which would otherwise push down on the carrier spine and degrade its integrity. Reasonable angle adjustments are allowable for saddles with elongated flaps or a wider gullet, to about 125 degrees.

Figure 2:
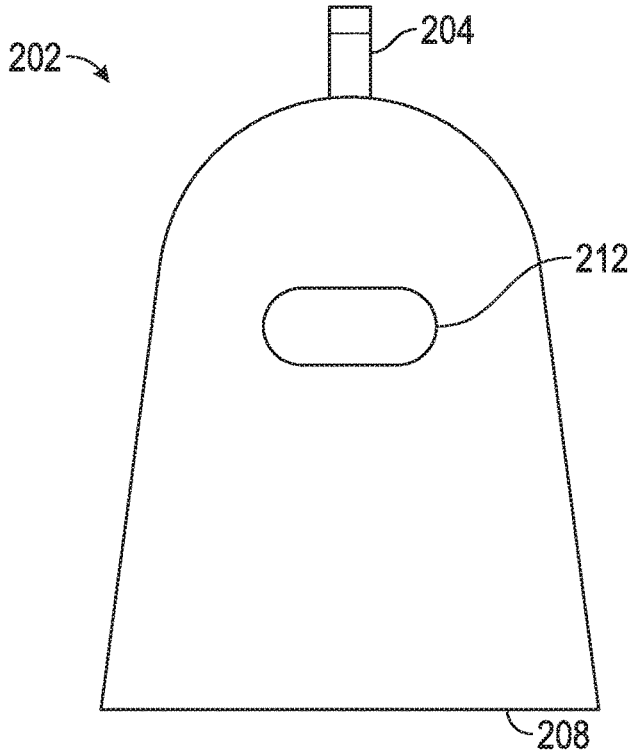
FIG. 2: rear view of one embodiment of the invention.

FIG. 2 depicts oeo the invention from a side view, featuring the upper crossbar rail 204 and featuring the groove central to said rail 204 (in notch FIG. 2 atop 204) (featured in Figures infra).

The side panels 208 are the most visibly substantial portion of the invention, and support the bulk of the saddle load via the top rail 204. Rounded side handles 212 are featured on both end panels 208. The saddle 202 (not shown) will be placed on (atop) the invention in the manner indicated by FIG. 2—arrow.

Figure 3:
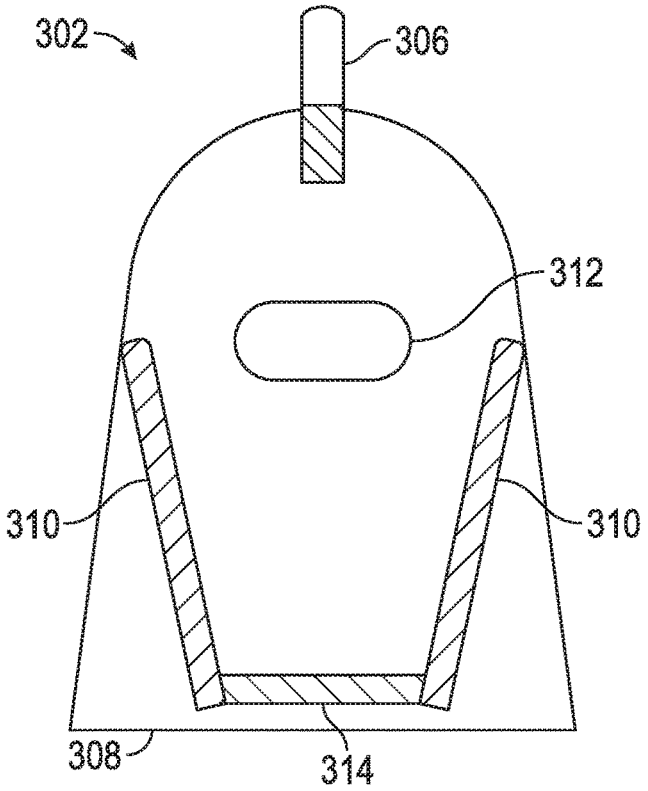
FIG. 3: rear internal view of one embodiment of the invention.

FIG. 3 features a skeletal plan view of the angled side rails 310, the portion of the top crossbar rail 306 as it rests inside the side panels 308, and the stable bottom rectangular base 314. The angled side panels 310 pieces feature rounded edges so as to preserve the sheepskin, wool and leather of the saddle, saddle pads, and saddle flaps.

Figure 4:
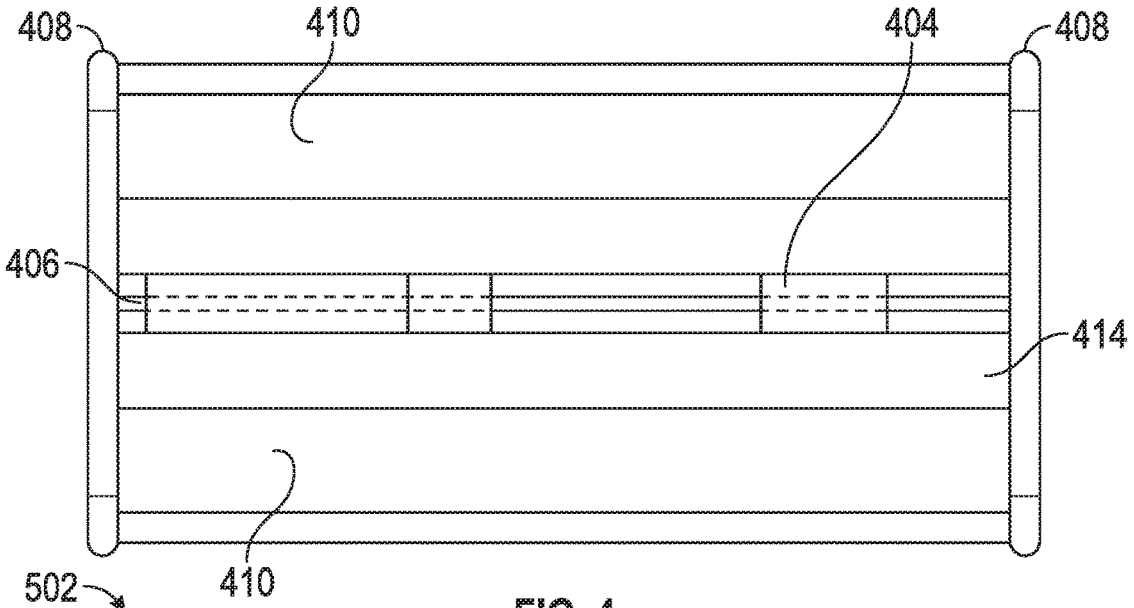
FIG. 4: aerial view of one embodiment of the invention.

FIG. 4 features the end panels 408, the top crossbar rail 406, cantle 404 and pommel 405 piece, both of which slide along the rail 406 via its central groove (herein shown without reference number). Side panels 410 and bottom rectangular base 414 are also shown.

Figure 5:
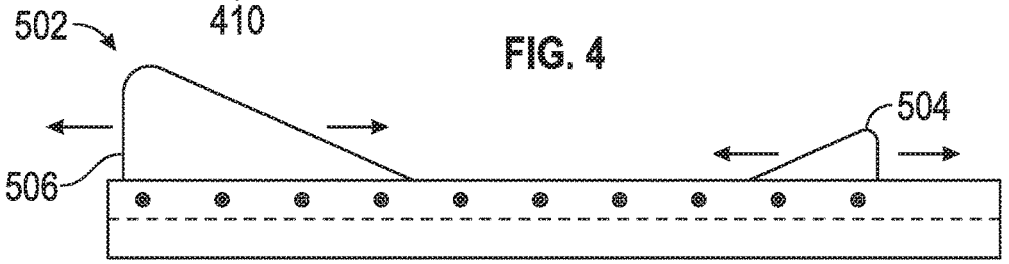
FIG. 5: side zoomed view of adjustable cantle and pommel pieces, comprising series of holes for sex bolts and other features shown.

FIG. 5 zooms to show the top rail pommel piece 506 and cantle piece 504, which slide along the central top crossbar rail, whose groove descends to the dotted line point, and whose holes for sex bolts run across the side of the crossbar. Said holes are substantially equidistant. In the preferred embodiment, the larger cantle piece comprises at least two holes for stable adjustment, while the smaller pommel piece comprises at least one hole for stable adjustment. In alternative embodiments, the cantle piece may also be permanently fixed.

Figure 6:
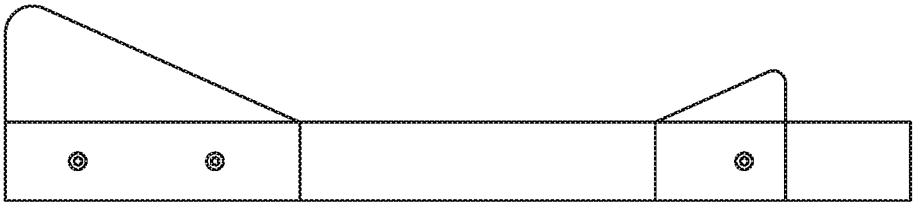
FIG. 6 depicts the precise method in which the sex bolt is unfastened, pommel&/or-cantle pieces moved to different position(s) to fit a differently-sized (or shaped) saddle, the re-fixed via holes & bolt.

FIG. 6 depicts the precise method in which the sex bolt is unfastened, pommel&/or-cantle pieces moved to different position(s) to fit a differently-sized (or shaped) saddle, the re-fixed via holes & bolt. Said pommel and cantle pieces are substantially triangular shaped; said cantle piece comprises, in oeo the invention, at least two holes, and said pommel piece comprises, in oeo the invention, at least one holes, for fixing the bolt through the top crossbar rail. In another embodiment, the cantle piece is permanently fixed to the top crossbar rail. The pommel piece may also be permanently fixed as well for individually tailored models.

Figure 7:
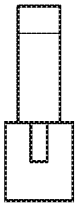
FIG. 7 depicts the sex bolt utilized in one embodiment of the invention.

FIG. 7 depicts the sex bolt, or moveable peg piece, utilized in one embodiment of the invention.

Figure 8:
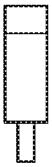
FIG. 8 depicts the unbolted shaft section of the sex bolt in one embodiment of the invention.

FIG. 8 depicts the internal mechanism of the bolt, or moveable peg piece, utilized in one embodiment of the invention.

Alternative Embodiments

1. The carrier bin wherein said carriers are stacked atop one another so as to create a multi-level rack, or tree, comprising multiple layers of the carrier.
2. The carrier bin wherein the base comprises casters for wheels.
3. The carrier bin built into the rear portion of a trailer to form a swing-out saddle rack for saddle and tack storage.
4. The carrier bin wherein the side panels are at least double the height of the sloped side panels, wherein the pommelend side panel disconnects from the top crossbar via hinge or latch, so as to allow the user access to the tack bin without removing the saddle. The crossbar rail could also hinge on the exterior of the end panels to allow multiple saddles to be supported (at least one saddle, e.g., on each side of the unit), while allowing the user to access the storage bin.

5. The carrier bin wherein a shoulder strap or truss apparatus is attached to at least one of said end panels for easier carrying.

6. The carrier bin wherein any of said fixed support pieces, including side and end panels, differs in size ratio and becomes adjustable to accommodate new saddle models, shapes and changing user preferences. Angles of side panels may also be adjustable, so long as they accomplish aforementioned structural endurance.

7. The carrier bin wherein said hand holes comprise rubberized gripping.

8. The carrier bin wherein a fastened or track-railed carrying means replaces said hand holes.

9. The carrier bin wherein said top rail crossbar features a gripping mechanism to allow the user to carry the invention as a common toolbox.

10. The carrier bin wherein the top rail crossbar is further extended to form a shelf in a rack of Carrier bins.

11. The Carrier bin wherein the top rail crossbar is removably fixed to the side panels, so as to allow the lower tack box to function independently.

12. The carrier bin wherein the adjustable pieces move via actuator upon prompt from a computer controller connected to sensors which measure and process at least a saddle's size and shape.

13. The carrier bin which raises the height of the carrier and storage bin to waist height, wherein the height is increased by making the arched front and back panels substantially less rounded to increase the height of the unit to waist-height (approximately between about 26" and 38").

14. The carrier bin wherein said top crossbar rail further comprises a shelf to accommodate stacking of additional carrier bins as a multi-level rack.

15. The carrier bin wherein said base further comprises casters for wheels.

16. The carrier bin wherein said arched front and back panels disconnect from said top crossbar via a latch mechanism, so as to allow access to said bin without removing an optionally positioned saddle atop said top crossbar rail.

Method of Manufacture

In one embodiment, the invention may be assembled as follows: the tallest end of the Fixed Support piece is screwed to one side of an End Panel above the Hand Hole. The smallest end of the Fixed Support piece is screwed to one side of a second End Panel near the top of the End Panel, above the Hand Hole in the same manner and mirrored position. One Side Panel piece is screwed to one side of the Bottom piece and a second Side Panel piece is screwed to the other side of the Bottom piece in the same manner and mirrored position. The assembled Side Panel pieces and Bottom are placed within the assembled Fixed Support piece and End Panel pieces. The Side Panel pieces and Bottom are screwed in to the End Panel piece. The Adjustable Support piece is set in place with a saddle resting against the Fixed Support piece and then mounted with two screws into the Fixed Support piece. The Adjustable Support piece may also be mounted in any of the pre-drilled screw holes in the Fixed Support piece, if less than a custom fit is desired. The apparatus device may also be assembled using a mortise and tenon [joint] method to secure the crossbar (rather than screws).

We claim:

1. A combination saddle carrier storage bin comprising:
- a substantially rectangular box, comprising;
  - a substantially rectangular base;
  - a proximal arched front panel and a substantially identical distal arched back panel,
    - wherein said front and back panels each comprise an upper region and a lower region;
  - two substantially rectangular side panels which fan upward and away from said base at about 91 degrees to about 139 degrees with respect to said base;
- an uppermost saddle-supporting top crossbar rail connecting said arched front panel to said arched back panel at said panels' upper region,
  - wherein said rail comprises a central groove along which slide substantially triangular-shaped cantle and pommel support pieces, said cantle and pommel support pieces being fixed via bolts, said bolts removably inserted into rail holes, said rail holes being substantially equally spaced along said rail.

2. The carrier bin of claim 1 wherein said angle is between about 112 degrees to about 125 degrees.

3. The carrier bin of claim 1 wherein said angle is 112 degrees.

4. The carrier bin of claim 1 wherein said angle is 125 degrees.

5. The carrier bin of claim 1 wherein said bolt is a standard/4" sex bolt.

6. The carrier bin of claim 1 wherein said bolt is a wooden peg.

7. The carrier bin of claim 1 wherein said bolt is a sex bolt with an external diameter of ⅝" and an internal diameter of 5/16".

8. The carrier bin of claim 1 wherein said arched front and back panels both further comprise substantially rounded hand holes.

9. The carrier bin of claim 1 wherein said pommel piece comprises at least one hole to accommodate said bolt.

10. The carrier bin of claim 1 wherein said cantle piece comprises at least two holes to accommodate said bolt.

11. The carrier bin of claim 1 wherein said cantle piece is permanently fixed inside said rail.

12. The carrier bin of claim 1 wherein said top crossbar rail and said front panel and said back panel are joined via mortise and tenon joint assembly.

13. The carrier bin of claim 1 wherein said top crossbar rail further comprises a shelf to accommodate stacking of additional carrier bins as a multi-level rack.

14. The carrier of claim 1 wherein said base further comprises casters for wheels.

15. The carrier bin of claim 1 wherein said arched front and back panels disconnect from said top crossbar via a hinge, so as to allow access to said bin without removing an optionally positioned saddle atop said top crossbar rail.

16. The carrier bin of claim 1 wherein said front panel further comprises a strap apparatus for carrying.

17. The carrier bin of claim 1 wherein said back panel further comprises at least one strap apparatus for carrying.

18. The carrier bin of claim 1 wherein said front panel further comprises a truss apparatus for carrying.

19. The carrier bin of claim 1 wherein said back panel further comprises at least one truss apparatus for carrying.

20. The carrier bin of claim 1 wherein said front and back panels further comprise rubber-edged hand holes for gripping.

* * * * *